United States Patent [19]

Huber et al.

[11] 3,953,914

[45] May 4, 1976

[54] MOUNTING ARRANGEMENT

[75] Inventors: Joseph B. Huber, Acme; Thomas A. Brown, Greensburg, both of Pa.

[73] Assignee: Kennametal Inc., Latrobe, Pa.

[22] Filed: Aug. 2, 1974

[21] Appl. No.: 494,082

[52] U.S. Cl. ..... 29/90 B; 29/125

[51] Int. Cl.[2] ..... B21C 37/30; B21B 31/08

[58] Field of Search ..... 29/90, 110, 117, 123, 29/125, 129.5

[56] References Cited

UNITED STATES PATENTS

| | | | |
|---|---|---|---|
| 2,465,376 | 3/1949 | Hooper | 29/125 X |
| 3,432,902 | 3/1969 | Rackoff et al. | 29/125 |
| 3,803,683 | 4/1974 | Oxlade | 29/125 |
| 3,842,471 | 10/1974 | Polhal | 29/125 |

*Primary Examiner*—Harrison L. Hinson

*Attorney, Agent, or Firm*—Melvin A. Crosby

[57] ABSTRACT

Hard wear resistant plates or rolls are provided with conical central recesses for receiving a conical keeper which clamps the plates or rolls to support members while centering the plates or rolls on the support members and preventing slipping of the plates or rolls on the support members.

7 Claims, 6 Drawing Figures

MOUNTING ARRANGEMENT

The present invention relates to an arrangement for centering and supporting hard wear resistant members, such as plates and rolls, on support members such as drive shafts or drive discs.

The particular device illustrated is a burnishing device and the mounted members are burnishing elements for use therewith.

The burnishing of rods and tubes and the like is known and this is accomplished by feeding the rods or tubes between a pair of opposed discs which rotate and which engage the work member being treated and smooth or burnish or polish the surface thereof while, also, bringing the work member to a desired outside diameter.

The treating of work members in the described manner is quite often carried out by the use of hard steel plates, but even when the work member being treated is relatively soft, such as copper, the plates wear out rapidly.

It has been found that burnishing or polishing plates of this nature when formed of a cemented hard metallic carbide material have extremely long life and retain the smooth finish imparted thereto for a longer period of time and do not become contaminated with pick up from the work members being treated. The present invention discloses an improved arrangement for supporting, locating and driving plates of the nature referred to.

Forming rolls represent another class of work members that can be supported by the mounting arrangement of the present invention. In this case, the section of the roll is maintained and maximum strength of the roll is realized.

BRIEF SUMMARY OF THE INVENTION:

According to the present invention, burnishing or polishing discs or forming rolls are made in the form of hard wear resistant bodies in the form of rolls or circular plates. Cemented hard carbide material is a suitable material for such bodies. The bodies are mounted on support members to be driven in rotation thereby.

The outwardly facing side of each body is formed with a conical recess and is bolted or threaded to a steel support member such as a disc or a shaft and thereby holds the body firmly on the support member in a centered position thereon.

Advantageously, the support member has a tenon in the center thereof engaging a central hole in the carbide body thereby further enhancing the ease with which the carbide body can be centered on the support member.

An object of the present invention is the provision of a device in which the carbide body which engages the work members being treated has exceptionally long life and wherein maximum strength is realized from the body.

Another object is the provision of a device of the nature referred to in which the elements which engage the work member being treated are constructed of a material which is not only extremely hard but which avoids contamination by the material being treated.

The foregoing objects as well as still other objects and advantages of the present invention will become more apparent upon reference to the following detailed specification taken in connection with the accompanying drawings in which.

DETAILED DESCRIPTION OF THE INVENTION

The drawings herein show, specifically, a burnishing arrangement, but it will be understood that forming rolls, such as are employed on rod mills, could be mounted according to the present invention. In a burnishing arrangement, ring-like elements are mounted on a support disc whereas, in a rod mill, rolls are mounted on a shaft. In each case, a conical keeper engages a conical recess in one side of the mounted body.

Figure 1:
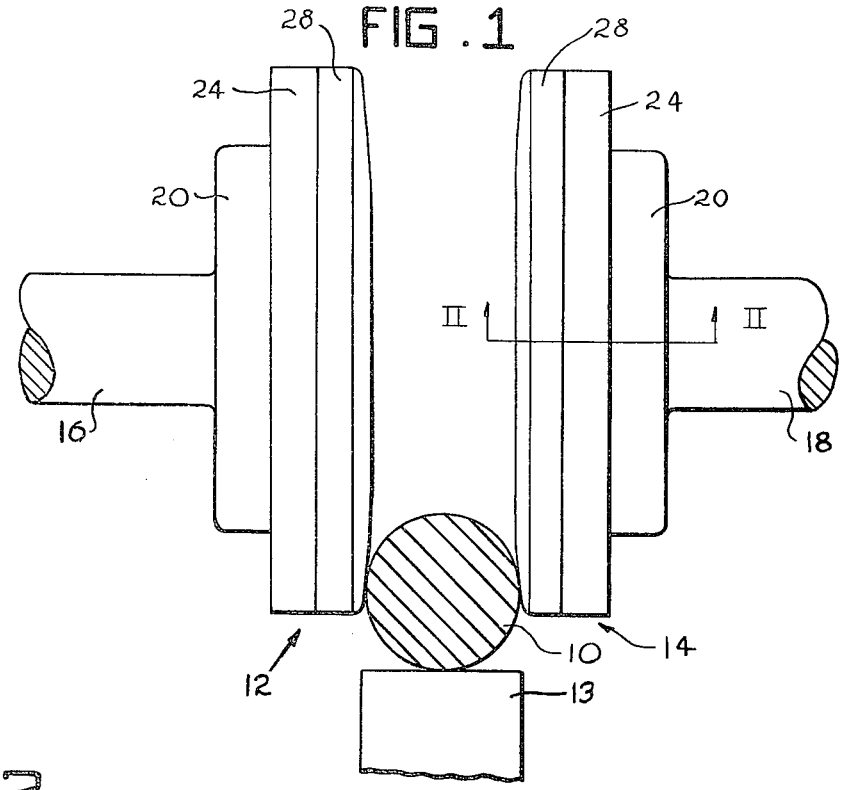
FIG. 1 is a somewhat schematic view of a burnishing or polishing arrangement having a ring-like element mounted according to the present invention looking endwise at a work member being treated.

Referring to the drawings somewhat more in detail, FIG. 1 shows a burnishing or polishing arrangement in which opposed substantially coaxial shafts 16 and 18 are provided on which are mounted elements according to the present invention as indicated at 28. Each of shafts 16 and 18 is flanged as at 20 and each flange 20 has connected thereto a support disc 24 and to which the respective element 28 is connected.

Figure 2:
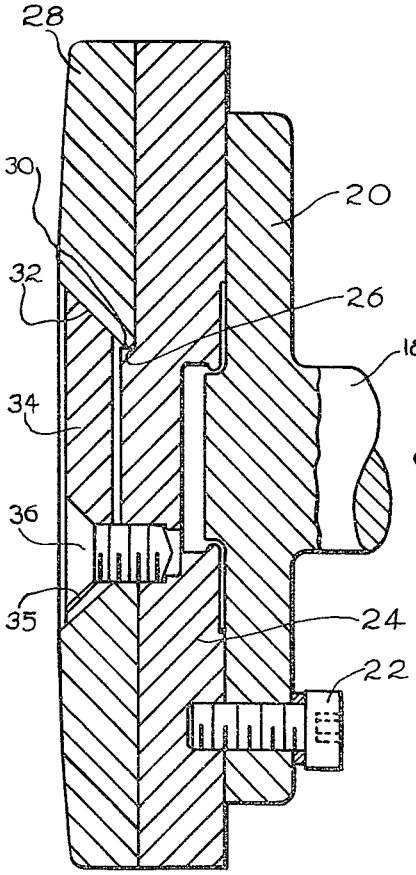
FIG. 2 is a sectional view indicated by line II—II on FIG. 1, drawn at somewhat enlarged scale, and showing in section a typical element for effecting the polishing and burnishing and mounted according to the present invention.

FIG. 2 shows more in detail the manner in which a support disc is secured to the shaft therefor. In this figure, it will be noted that support disc 24 has a central tenon thereon at 26 which is received in a central hole 30 provided in plate 28. Plate 28 on the side facing support disc 24 is planar and is in face to face engagement with the support disc. The other side of the plate 28 in FIG. 2 is smoothly polished and on the axis thereof comprises a conical recess 32 communicating with central bore 30 referred to above.

Figure 3:
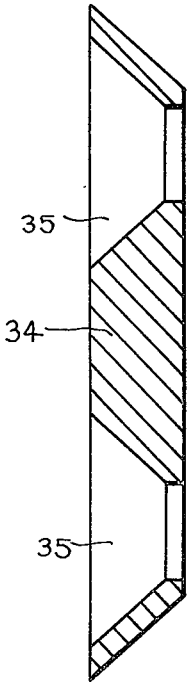
FIG. 3 is a view drawn at enlarged scale showing the conical keeper according to the present invention which clamps the work element to the support disc provided therefor.

Conical recess 32 is adapted for receiving a conical keeper 34 and keeper 34, as will be seen in FIG. 3, comprises holes 35 for receiving the cone headed screws 36 which are threaded into support disc 24. The provision of the conical recess in the plate 28 in the central hole in the plate into which tenon 26 extends provides for accurate centering of the plate on the support disc when keeper 34 and cone headed screws 36 are put in place and pulled up tight.

Plate 24 is, in turn, connected to flange 20 as by cap screws 22 and may be centered thereon by a corresponding tenon and central recess arrangement as shown in FIG. 2.

Figure 4:
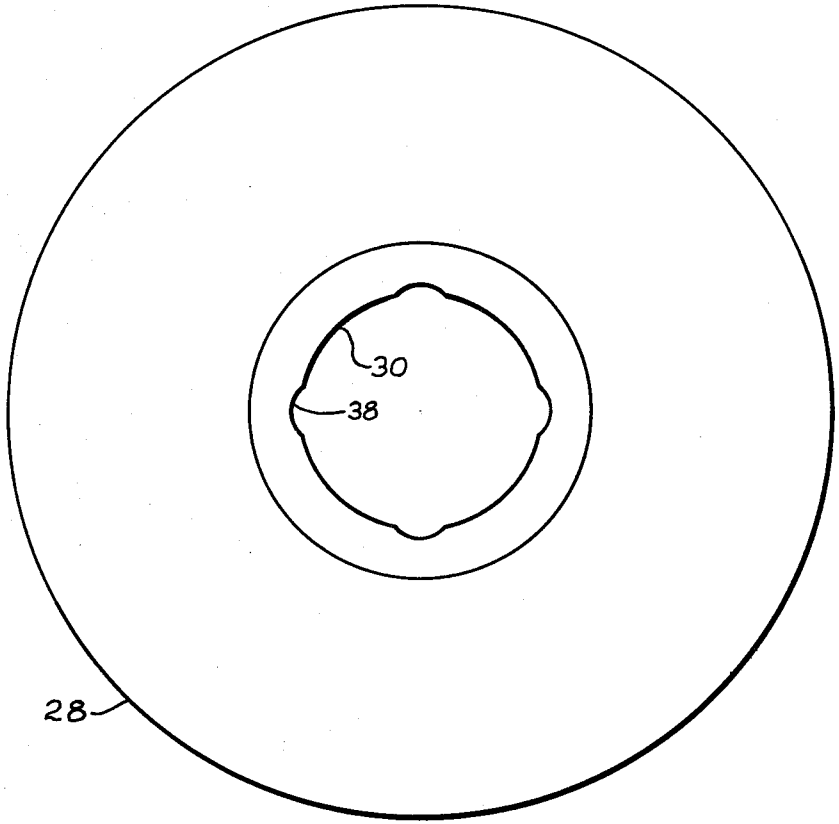
FIG. 4 is an elevational view drawn at enlarged scale looking in at the face of a typical burnishing element adapted for mounting in accordance with the present invention.

FIG. 4 shows one of the discs 28 looking in at the front thereof and will show that central hole 30 is provided with circumferential notches 38 through which the cone headed screws 36 extend. The provision of the notches 38 also provides means for keying the plate 28 to the support disc 24 so that rotation of plate 28 on the support disc is absolutely prevented.

Figure 5:
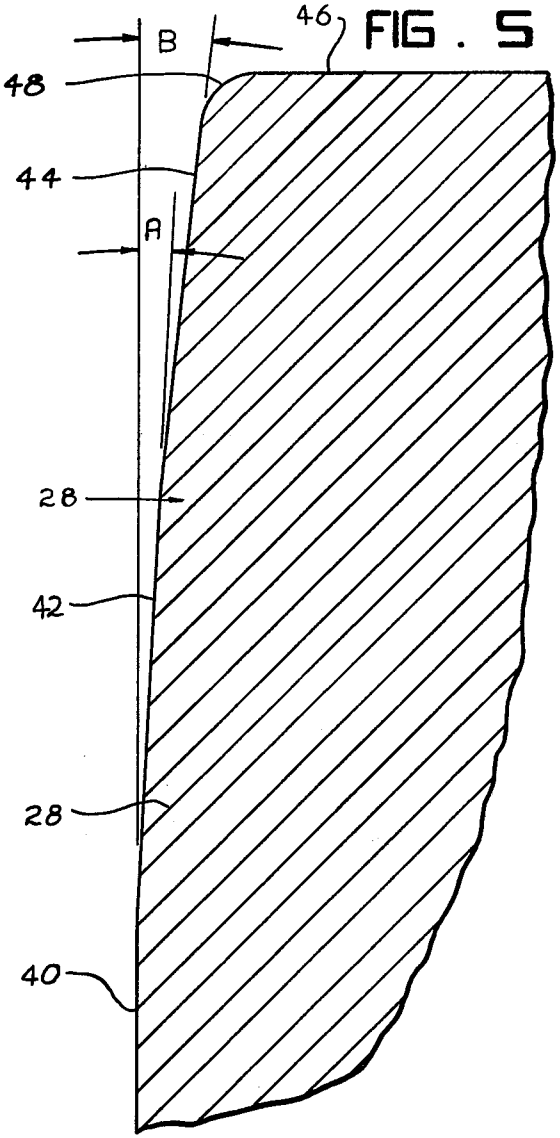
FIG. 5 is a view drawn at still more greatly enlarged scale showing details in respect of the construction of the burnishing element of FIG. 4.

FIG. 5 shows at enlarged scale the manner in which the side of plate 28 which faces the other disc 28 is formed. The disc is provided with a central region 40 which is planar and perpendicular to the central axis of the plate and surrounding central region 40 is a radially inner annular region 42 inclined rearwardly to form an included angle A with the plane of central region 40. This angle A may be about 15°.

Surrounding radially inner region 42 is a radially outer region 44 which makes an included angle with the plane of central region 40 of about 30 degrees as indicated at B. The annular regions 42 and 44 may be about the same extent and are so disposed that the line of intersection of the envelope of radially outer region 44 with the plane of the central region 40 is in about the middle of radially inner region 42 when the plane is viewed in the axial direction as in FIG. 4.

The plate has a cylindrical circumferential region 46 and the end of region 46 is connected with the radially outer edge of region 44 by a fillet 48 and which, for a plate which is about 5 ½ inches in diameter, could be formed at a radius of about 0.19 inches.

Returning for the moment to FIG. 1, the plates 28 shown therein, and which are in opposed spaced relation, are substantially identical and are spaced apart far enough to receive therebetween a work member 10. Work member 10 is supported by a guide 13, which may be formed of carbide material.

In operation, the work member 10 moves in the direction of its axis between the plates 28 near the periphery thereof and with the plates rotating, the work member 10 also rotates and the entire outer surface thereof is burnished and polished and brought to the proper size during axial movement of the work member 10 between the plates 28.

Figure 6:
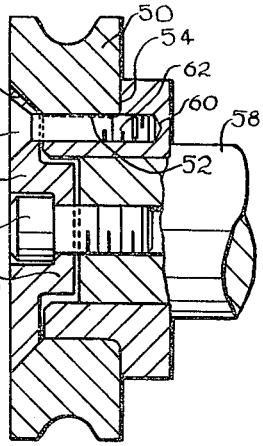
FIG. 6 shows the present invention adapted to the support of a forming roll.

FIG. 6 shows the manner in which the present invention can be adapted to the support of a forming roll. In FIG. 6, the forming roll 50 is provided with a central hole 52 and one side of the roll comprises an annular abutment area 54 while the other side is provided with a conical recess 56.

Support shaft 58 is provided with a collar 60 which may be a press fit or a shrink fit on the shaft or it may even be formed integrally therewith. Collar 60 engages abutment area 54 of the forming roll and includes a cylindrical portion 62 extending into the central hole of the forming roll.

A conical keeper or clamp member 64 is provided having a thickened central region 66 extending axially toward the end of shaft 58. Region 66 of the clamp member stiffens the clamp member and also provides space for inserting a central cap screw 68 which threadedly engages the shaft and assists in clamping the assembly together.

The cone headed screws 70 extend through the conical clamp member near the periphery thereof threadedly engaging the collar 60.

Modifications may be made within the scope of the appended claims.

We claim:

1. A support device for a burnishing roll comprising a ring-like member of cemented hard metal carbide, said member having an abutment region on one side and having a central conical recess in the other side, said abutment region adapted for abutting a steel support, a conical clamp element in said recess, and bolts extending through said clamp element and threadedly engaging said steel support, said other side of said ring-like member having a central region which is perpendicular to the central axis of the ring-like member and an outer region which inclines rearwardly from the periphery of said central region, said outer region having a radially inner portion which inclines at a smaller included angle to the plane of said central region and a radially outer portion which inclines at a larger included angle to the plane of said central region.

2. A support device according to claim 1 in which said smaller angle is about 15° and said larger angle is about 30°.

3. A support device according to claim 1 in which said conical recess terminates at the small end in a central hole in the ring-like member.

4. A support device according to claim 3 in which said hole is peripherally notched for receiving said bolts.

5. A support device according to claim 2 in which the steel support member engaging said abutment region has a tenon extending into said hole in said ring-like member.

6. A burnishing or forming roll according to claim 1 wherein said conical recess extends only partially the length of said central hole in said ring-like member.

7. A burnishing or forming roll according to claim 1 wherein the conical clamp when seated in said conical recess extends no further than flush with the surface of the ring-like member.

* * * * *